US008061915B2

(12) United States Patent
Kubota et al.

(10) Patent No.: US 8,061,915 B2
(45) Date of Patent: Nov. 22, 2011

(54) TAPE PROCESSING APPARATUS

(75) Inventors: Tomoyuki Kubota, Shiojiri (JP); Kenichi Nakajima, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 761 days.

(21) Appl. No.: 12/121,605

(22) Filed: May 15, 2008

(65) Prior Publication Data

US 2008/0298872 A1 Dec. 4, 2008

(30) Foreign Application Priority Data

Jun. 4, 2007 (JP) ..... 2007-148504

(51) Int. Cl.
*B41J 11/66* (2006.01)
*B41J 11/70* (2006.01)
*B65H 35/04* (2006.01)

(52) U.S. Cl. ..... 400/621; 400/611

(58) Field of Classification Search ..... 400/621; *B41J 11/66, 11/70; B65H 35/04, 20/04*
See application file for complete search history.

(56) References Cited

U.S. PATENT DOCUMENTS

| | | | | |
|---|---|---|---|---|
| 5,437,512 | A | 8/1995 | Giill | |
| 6,030,135 | A * | 2/2000 | Imai | 400/621 |
| 6,491,460 | B1 * | 12/2002 | Sodeyama et al. | 400/613.1 |
| 7,322,762 | B2 * | 1/2008 | Murata et al. | 400/615 |
| 2007/0147939 | A1 * | 6/2007 | Moriyama et al. | 400/621 |

FOREIGN PATENT DOCUMENTS

| | | | |
|---|---|---|---|
| JP | 62244866 | A * | 10/1987 |
| JP | 01128860 | A * | 5/1989 |
| JP | 01216869 | A * | 8/1989 |
| JP | 01238969 | A * | 9/1989 |
| JP | 02158370 | A * | 6/1990 |
| JP | 06061490 | U | 8/1994 |
| JP | 06509289 | A | 10/1994 |
| JP | 2000071523 | A | 3/2000 |
| JP | 2003-237155 | | 8/2003 |
| JP | 2004115140 | A * | 4/2004 |
| JP | 2004291603 | A * | 10/2004 |
| JP | 2006142835 | A * | 6/2006 |

OTHER PUBLICATIONS

Machine Translation of JP 2006142835 A, JPO, Feb. 8, 2011.*

* cited by examiner

*Primary Examiner* — Matthew G Marini
*Assistant Examiner* — Nguyen Q Ha
(74) *Attorney, Agent, or Firm* — DLA Piper LLP (US)

(57) ABSTRACT

Provided herein is a tape processing apparatus having: a tape cutting device which slides a cutter holder having a cutter blade attached therein in a reciprocating sliding directions and cuts a tape by a forward sliding movement thereof; and a tape ejecting device which faces to a tape ejecting path from the tape cutting device to a tape ejecting slot and eject a tape piece of the tape forcibly from the tape ejecting slot by contacting in rotation with the cut tape piece; wherein the tape ejecting device having: an ejecting roller which contacts in rotation with the tape piece; and a power conversion mechanism which is placed between the ejecting roller and the cutter holder, converts a backward sliding movement of the cutter holder to a rotational movement for the ejecting roller, and transmits the rotational movement to the ejecting roller.

7 Claims, 11 Drawing Sheets

TAPE PROCESSING APPARATUS

The entire disclosure of Japanese Patent Application No. 2007-148504, filed Jun. 4, 2007, is expressly incorporated by reference herein.

BACKGROUND

1. Technical Field

The present invention relates to a tape processing apparatus which cuts a printed portion of a tape by a sliding movement and ejects the portion outside the apparatus.

2. Related Art

Conventionally, as this kind of a tape processing apparatus, there is known a tape printing apparatus which has a print-feed mechanism feeding a tape and printing thereon, a cutting mechanism cutting a printed portion of the tape (a tape piece) by sliding a cutter blade, and a single driving motor driving the print-feed mechanism and the cutting mechanism selectively via a clutch mechanism. JP A-2003-237155 is an example of related art. In this tape printing apparatus, a printing process is performed by the print-feed mechanism with rotating the driving motor in a normal direction and switching the clutch mechanism thereto. After the printing process, a cutting process is performed by the cutting mechanism with rotating the driving motor in a reverse direction and switching the clutch mechanism thereto.

However, in the tape printing apparatus described above, the apparatus is not so constructed that the tape piece after cutting off is not ejected forcibly outside the apparatus. In a case where an ejecting path from the cutting mechanism to an ejecting slot is long or where a tape length of the tape piece is short, the tape piece may not be certainly ejected outside the apparatus.

Also, in a case where an ejecting mechanism is provided in the tape printing apparatus described above to eject the tape piece forcibly, it is necessary to provide an ejecting drive motor for driving the ejecting mechanism or a power transmission mechanism from the ejecting drive motor to the ejecting mechanism, leading to a bulky apparatus and a complex structure therein.

SUMMARY

An advantage of some aspects of the invention is to provide a tape processing apparatus which has a simple structure and can eject a tape piece outside an apparatus.

According to one aspect of the invention, there is provided a tape processing apparatus having: a tape cutting device which slides a cutter holder having a cutter blade attached therein in a reciprocating sliding directions and cuts a tape by a forward sliding movement thereof; and a tape ejecting device which faces to a tape ejecting path from the tape cutting device to a tape ejecting slot and eject a tape piece of the tape forcibly from the tape ejecting slot by contacting in rotation with the cut tape piece; wherein the tape ejecting device including: an ejecting roller which contacts in rotation with the tape piece; and a power conversion mechanism which is placed between the ejecting roller and the cutter holder, converts a backward sliding movement of the cutter holder to a rotational movement for the ejecting roller and transmits the rotational movement to the ejecting roller.

According to this configuration, the backward sliding movement of the cutter holder is converted to a rotational movement for the ejecting roller and the rotational movement is transmitted to the ejecting roller. Therefore, just after the tape is cut off, a force for forcible ejection impinges on the tape piece via the ejecting roller. In other words, as a tape cutting normal movement is used for an ejecting movement as a driving source, it is not necessary to provide a driving motor or the like additionally and is certainly possible to eject the tape piece through the tape ejecting slot outside the apparatus.

In this case, it is preferable that the tape ejecting device further has a receiving member for the tape piece which is provided in the cutter holder and interposes the tape piece with the ejecting roller preceding a rotation of the ejecting roller.

According to this configuration, as the receiving member for the tape piece interposes the tape piece with the ejecting roller preceding a rotation of the ejecting roller, the tape piece is ejected from a state in which the tape piece is interposed (held). By this procedure, when the ejecting roller rotates by the backward sliding movement in the backward sliding movement, the tape piece can certainly be ejected. For example, even if the tape piece is short, the tape piece can certainly be ejected without occurring a jamming or the like.

In this case, it is preferable that the receiving member for the tape piece has a sub roller provided rotatably in the cutter holder.

According to this configuration, it is possible to form the receiving member for the tape piece in a simple manner. When the ejecting roller is rotated in the backward sliding movement, consequently, the sub roller is also rotated, then the tape piece can be certainly and smoothly ejected.

In these cases, it is preferable that the power conversion mechanism has: a frictional wheel fixed on a roller shaft of the ejecting roller; a frictional top which is provided in the cutter holder and is capable of rotating freely between a sliding contact position in which the frictional top is in sliding contact with the frictional wheel and makes the frictional wheel rotate and a pull-off position in which the frictional top is pulled off from the frictional wheel; and a check mechanism which is provided in the cutter holder, allows the frictional top to rotate toward the pull-off position by the frictional wheel in the forward sliding movement of the cutter holder and holds the frictional top at the sliding contact position in the backward sliding movement.

According to these configurations, as the check mechanism allows the frictional top to rotate toward the pull-off position in the forward sliding movement, it is possible to rotate the ejecting roller only in the backward sliding movement and the cutting movement in the forward sliding movement is not affected. On the other hand, as the frictional top is held in the sliding contact position by the check mechanism, it is certainly possible to rotate the frictional wheel by sliding contact with the frictional top.

In this case, it is preferable that the check mechanism has a return spring which urges the frictional top toward the sliding contact position, and a contact section which holds the frictional top at the sliding contact position against the return spring.

According to this configuration, the check mechanism can be formed in a simple manner.

In these cases, it is preferable that the tape cutting device further has a tape receiving member which faces to the tape ejecting path and receives the tape in cutting and a tape retaining member which is provided in the cutter holder and retains the tape with the tape receiving member preceding a cut of the cutter blade into the printing tape, the frictional top begins to contact slidingly with the frictional wheel just before the tape retaining member separates from the tape receiving member in the backward sliding movement of the cutter holder.

According to these configurations, it is certainly possible to hold the tape in cutting by the forward sliding movement and to release a holding of the tape piece in ejecting by the backward sliding movement. Also, as soon as the tape piece is released, it is possible to eject the tape piece instantly. Therefore, a series of movements from the cutting movement to the ejecting movement can be performed efficiently.

In this case, it is preferable that the sub roller, the tape retaining member and the cutter blade contact with the tape sequentially in the forward sliding movement of the cutter holder, and the cutter blade, the tape retaining member and the sub roller separates from the tape T sequentially in the backward sliding movement of the cutter holder.

According to this configuration, in the forward sliding movement, as the sub roller and the tape retaining member contact with the tape preceding the cutter blade in the forward sliding movement, the tape retaining member retains the tape and the sub roller assists the tape retaining member, it is possible to cut the tape in a state that the tape is surely retained. On the other hand, as the sub roller separates from the tape following the tape retaining member in the backward sliding movement, a tape ejecting process can certainly be performed by cooperating with the ejecting roller.

In these cases, it is preferable to have a printing device which prints on the tape.

According to these configurations, it is possible certainly to eject the tape piece of the printed tape through the ejecting slot outside the apparatus regardless of the length thereof.

BRIEF DESCRIPTION OF THE DRAWINGS

The invention will be described with reference to the accompanying drawings, wherein like numbers reference like elements.

DESCRIPTION OF EXEMPLARY EMBODIMENTS

A tape printing apparatus applied to a tape processing apparatus according to an embodiment of the invention will be explained hereinafter with reference to accompanying drawings. The tape printing apparatus prints on an printing tape, cuts off a printed portion of a tape by sliding movement, and ejects a tape piece (label) outside the apparatus. Note that "the front", "the rear", "the left", "the right", "the upper", and "the lower" correspond to directions seen from a user who uses the tape printing apparatus.

Figure 1:
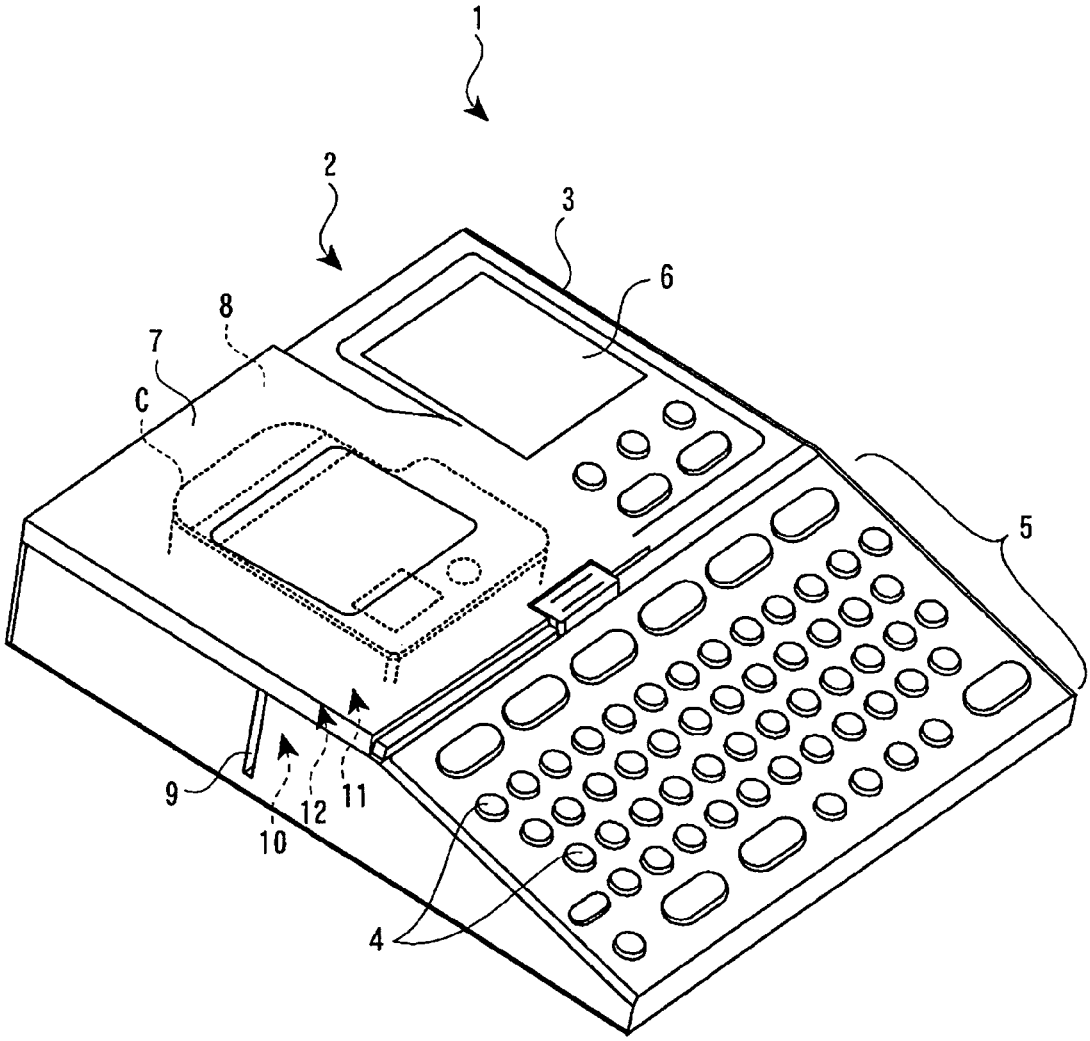
FIG. 1 is a perspective view of a tape printing apparatus according to an embodiment of the invention.
Figure 2:
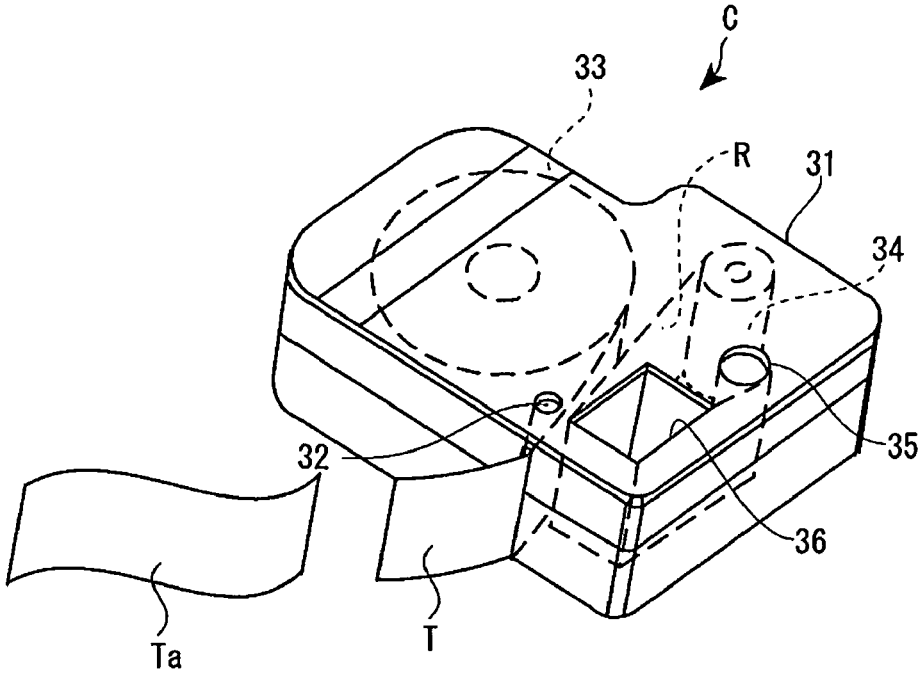
FIG. 2 is a perspective view of a tape cartridge and a cartridge mounting section therefor.
Figure 2:
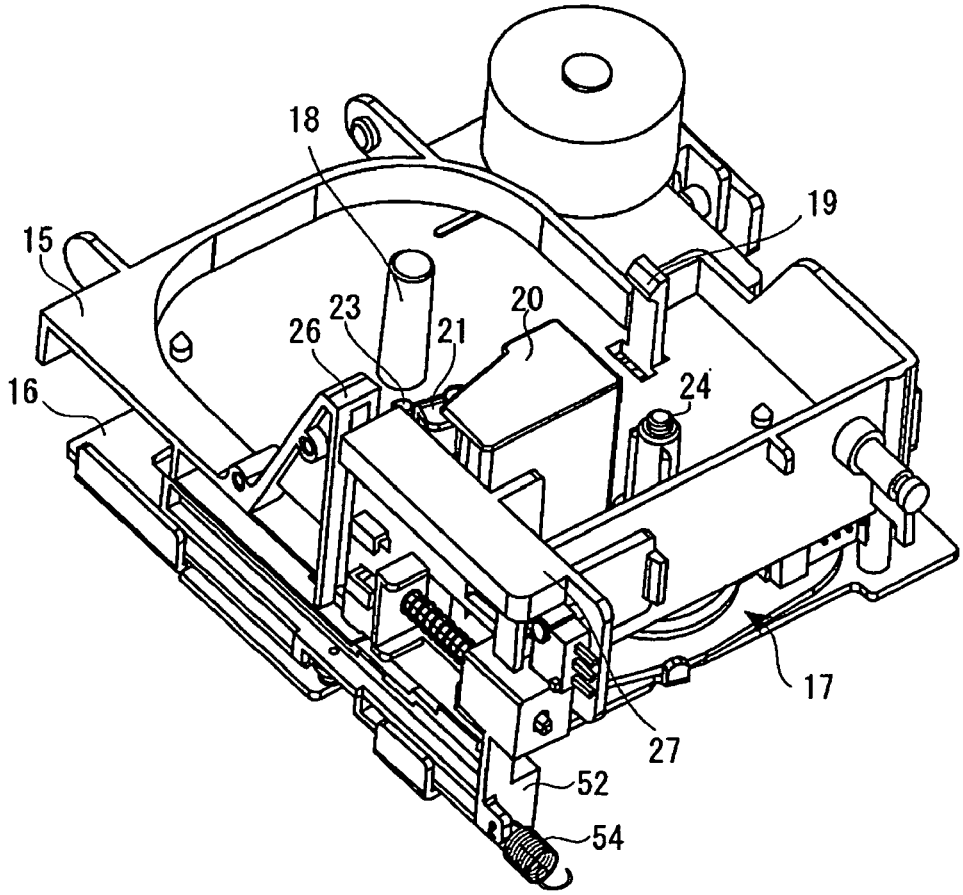

As shown in FIGS. 1 and 2, a tape printing apparatus 1 has an apparatus body 3 which forms an outer shell by an apparatus casing 2 and a tape cartridge C detachably mounted on the apparatus body 3. A printing tape T having a release paper to be a printed object is accommodated to be paid out freely in the tape cartridge C.

A key input section 5 including various input keys 4 is arranged on the upper surface of the apparatus casing 2 at the front side thereof. A liquid crystal display 6 showing an input result, etc., from the key input section 5 is provided on the upper surface of the apparatus casing 2 at the rear right side thereof. The apparatus casing 2 has an opening-closing lid 7 on the upper surface at the rear left side thereof, and a cartridge mounting section 8 in which the tape cartridge C is mounted detachably is provided inside the opening-closing lid 7. At the left side of the apparatus casing 2, a tape ejecting slot 9 is formed in communication with the cartridge mounting section 8. A tape ejecting path 10 is formed between the tape ejecting slot 9 and the cartridge mounting section 8. Seen from an upper stream, there are accommodated a tape cutting mechanism (a tape cutting device) 11 and a tape ejecting mechanism (a tape ejecting device) 12 so as to face the tape ejecting path 10 (details thereof will be explained later) in the tape printing apparatus. The tape cutting mechanism 11 cuts off the printing tape T by a reciprocating sliding movement and the tape ejecting mechanism 12 forcibly ejects a tape piece Ta of the cut printing tape T from the tape ejecting slot 9.

Figure 3:
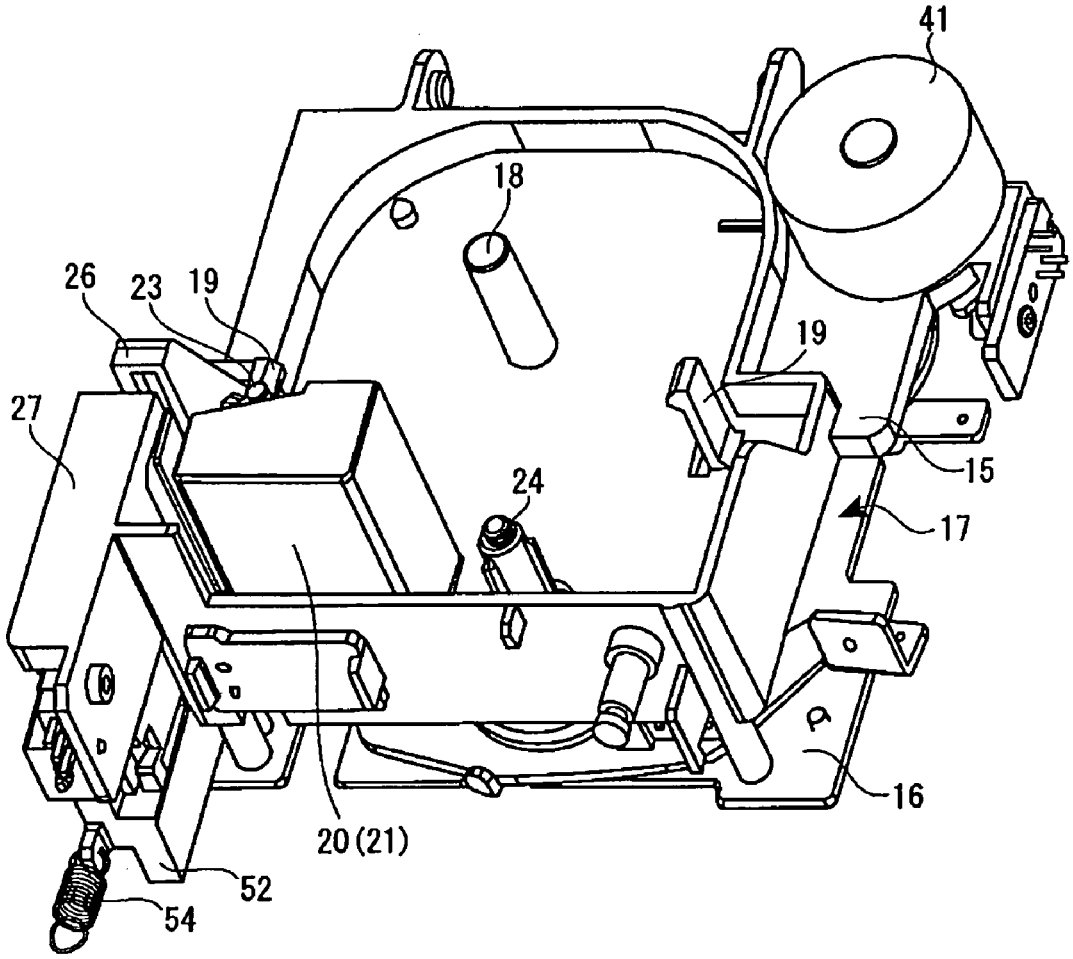
FIG. 3 is a perspective view of the cartridge mounting section and the vicinity thereof.

As shown in FIGS. 2 and 3, a mounting plate 15 which is separated from the apparatus casing 2 is provided in the lower half side of the cartridge mounting section 8. A base frame 16 is provided in parallel with the mounting plate 15 having a space therebetween at the lower side of the mounting plate 15. The mounting plate 15 is supported by the base from 16, and a tape feeding mechanism 17 and the like are arranged therebetween. The bottom surface of the mounting plate 15 has a guide boss 18 and a pair of retaining claws 19 for the tape cartridge C, a printing head (a printing device) 21 extending from the base frame 16 and having a head cover 20, a platen shaft 23 facing to the printing head 21 and a ribbon take-up shaft 24 for an ink ribbon R, all of which being projected vertically. A tape receiving section (a tape receiving member) 26 which is in a form of deformed reversed "V" and a guide section 27 which extends overhangly in a horizontal direction are formed integrally across the tape ejecting path 10 (see FIG. 2. Details thereof will be explained later).

As shown in FIG. 2, the tape cartridge C is constructed with a cartridge case 31 having an upper case and a lower case, in which the printing tape T, the ink ribbon R and a platen 32 are accommodated. The printing tape T is wound up into a tape reel 33, and the ink ribbon R is wound up in a ribbon pay out reel 34 and a ribbon take-up reel 35, each of which being accommodated to be freely rotatable in the cartridge case 31. The platen 32 is also accommodated to be freely rotatable in the cartridge case 31, in which the platen 32 is adjacent to an opening 36 for the printing head 21. The printing tape T and the ink ribbon R are paid out from the tape reel 33 and the ribbon pay out reel 34, respectively. The printing tape T and the ink ribbon R overlappingly run at the opening 36, then, the printing tape T is delivered outside the tape cartridge case 31 and the ink ribbon R is taken up into the ribbon take-up reel 35. At an area in which the printing tape T and the ink ribbon R run together, the platen 32 and the printing head 21 face to them so as to place therebetween, whereby a printing is performed.

When the tape cartridge C constructed as above is mounted on the cartridge mounting section 8, the platen 32 and the ribbon take-up reel 35 are engaged in the platen shaft 23 and the ribbon take-up shaft 24, respectively, and the printing head 21 is movably inserted in the opening 36. After the opening-closing lid 7 is closed, the printing head 21 rotates and the printing tape T and the ink ribbon R are interposed between the printing head 21 and the platen 32, leading to a print waiting state.

When a printing operation is commanded, the tape feeding mechanism 17 is driven, the printing tape T is paid out from the tape cartridge C, and the printing head 21 is driven to print on the printing tape T as desired. Together with the printing operation, the ink ribbon R is taken up in the tape cartridge C, while the printed portion of the printing tape T is delivered outside the apparatus through the tape ejecting slot 9. After the printing is completed, a feeding for a margin is performed, and a running of the printing tape T and the ink ribbon R stops. Then, the printing tape T is cut off by the tape cutting mechanism 11 and the tape ejecting mechanism 12 is activated in conjunction with the cutting movement. The tape piece Ta of the cut printing tape T is ejected forcibly through the tape ejecting slot 9, thereby the label printed desired characters or the like thereon is formed.

Figure 4:
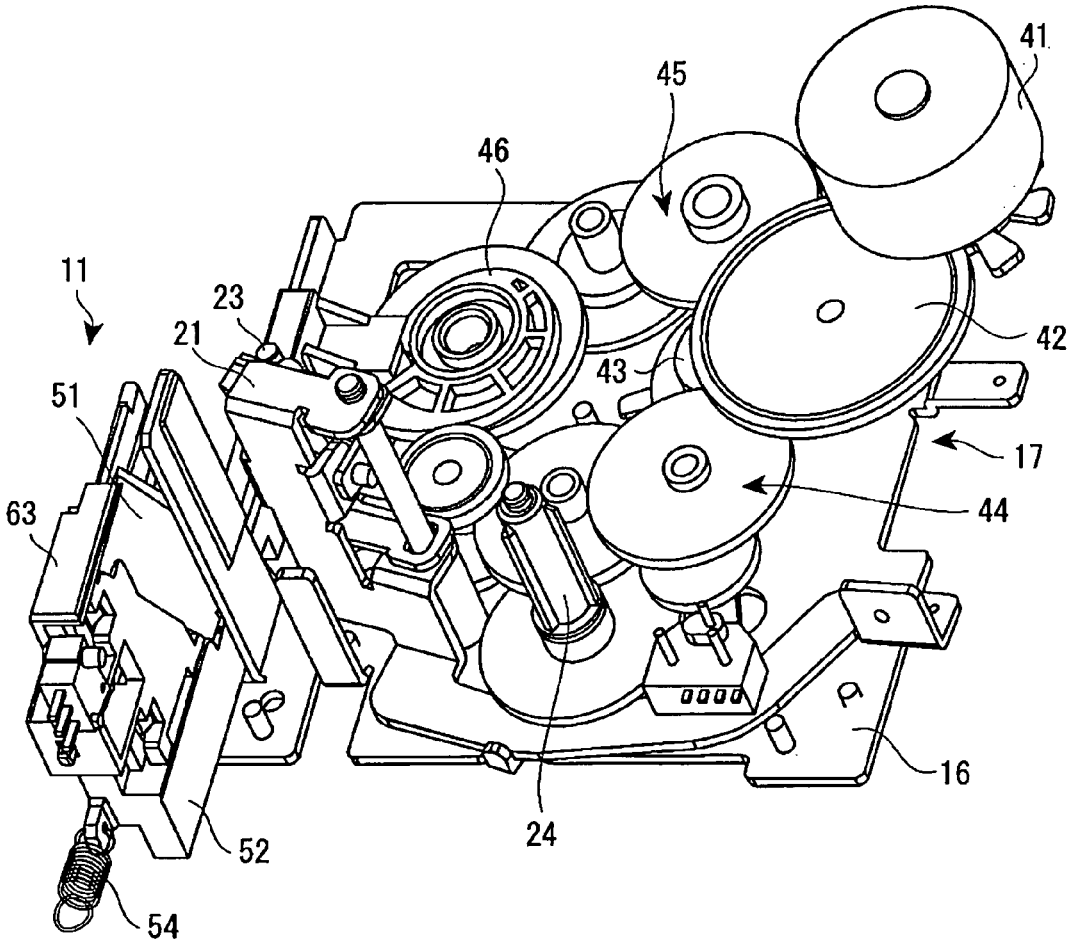
FIG. 4 is a perspective view of a power system for a tape feeding mechanism and a tape cutting mechanism.
Figure 5:
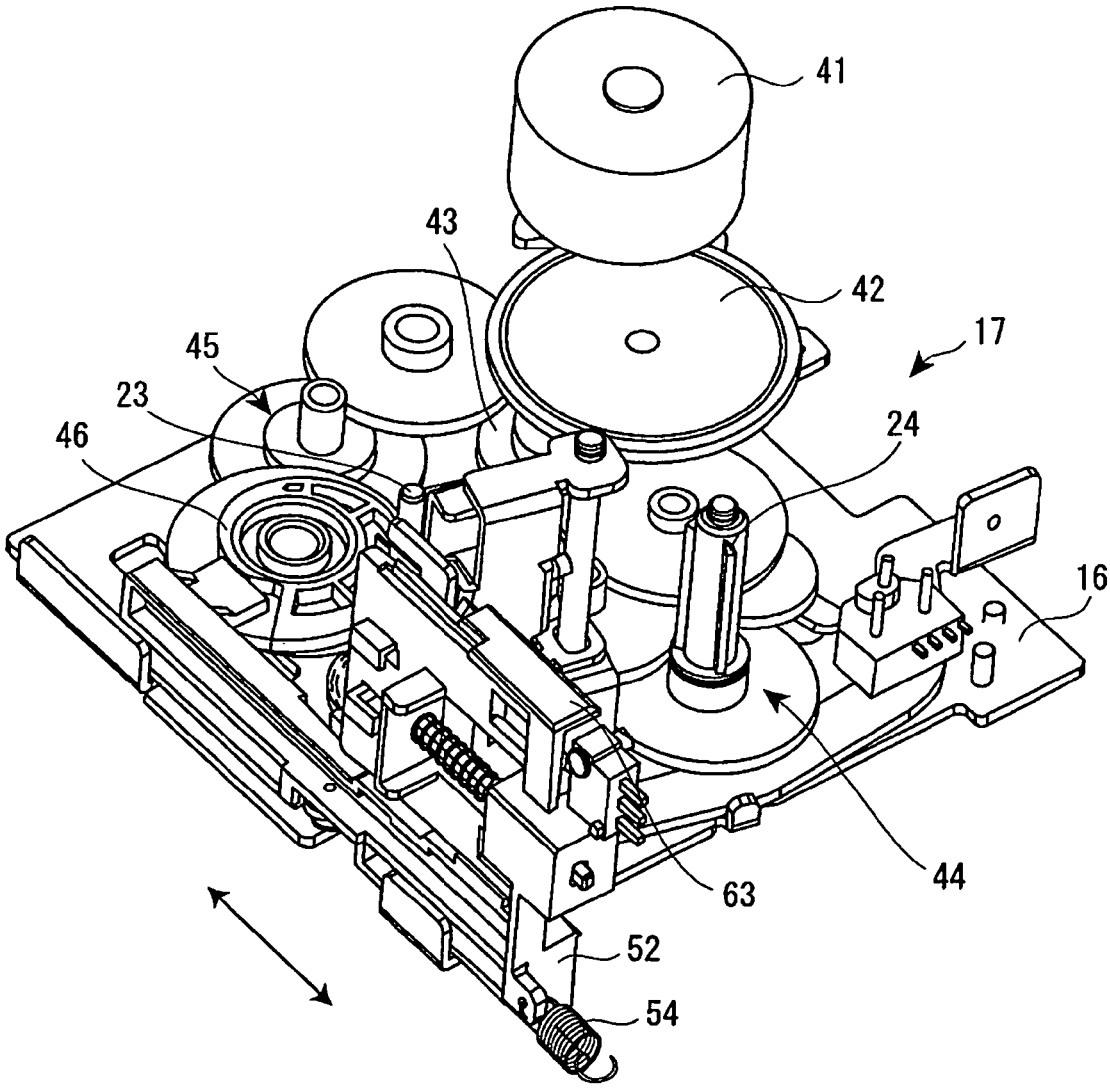
FIG. 5 is a perspective view of the power system for the tape feeding mechanism and the tape cutting mechanism seen from a tape ejecting slot side.

Referring to FIGS. 4 and 5, a power system for the tape feeding mechanism 17 and the tape cutting mechanism 11 will be explained hereinbelow. The power system includes: a motor 41 which is a power source; an input gear 42 meshing with a gear formed on a main shaft of the motor 41; a clutch mechanism 43 meshing with the input gear 42; and a feeding side gear train 44 and a cutting side gear train 45 which are power-linked selectively by the clutch mechanism 43. An output end of the feeding side gear train 44 is divided into two and linked to the platen shaft 23 and the ribbon take-up shaft 24, respectively. An output end of the cutting side gear train 45 is linked to a cut operation cam 46 of the tape cutting mechanism 11. In this case, the motor 41 is fixed to one end of the mounting plate 15, and the input gear 42, the clutch mechanism 43, the feeding side gear train 44 and the cutting side gear train 45 are assembled in the base frame 16 (see FIG. 4).

The motor 41 is constructed to be capable of rotating in normal and reverse directions. When the motor 41 rotates normally, a rotational power is transmitted to the clutch mechanism 43 and the clutch mechanism 43 switches to the feeding side gear train 44 automatically, thereby the platen shaft 23 and the ribbon take-up shaft 24 are rotated. Therefore, the platen 32 and the ribbon take-up reel 35 of the tape cartridge C are rotated, and the printing tape T and the ink ribbon R are fed simultaneously. On the other hand, when the motor 41 is rotated reversely, the rotational power is transmitted to the clutch mechanism 43 and the clutch mechanism 43 switches to the cutting side gear train 45 automatically, thereby the cut operation cam 46 is rotated. By the rotation of the cut operation cam 46 (a cam action), a cutter blade 51 is operated to cut off (a reciprocating sliding movement) with a cutter holder 52 (described later).

Figure 6:
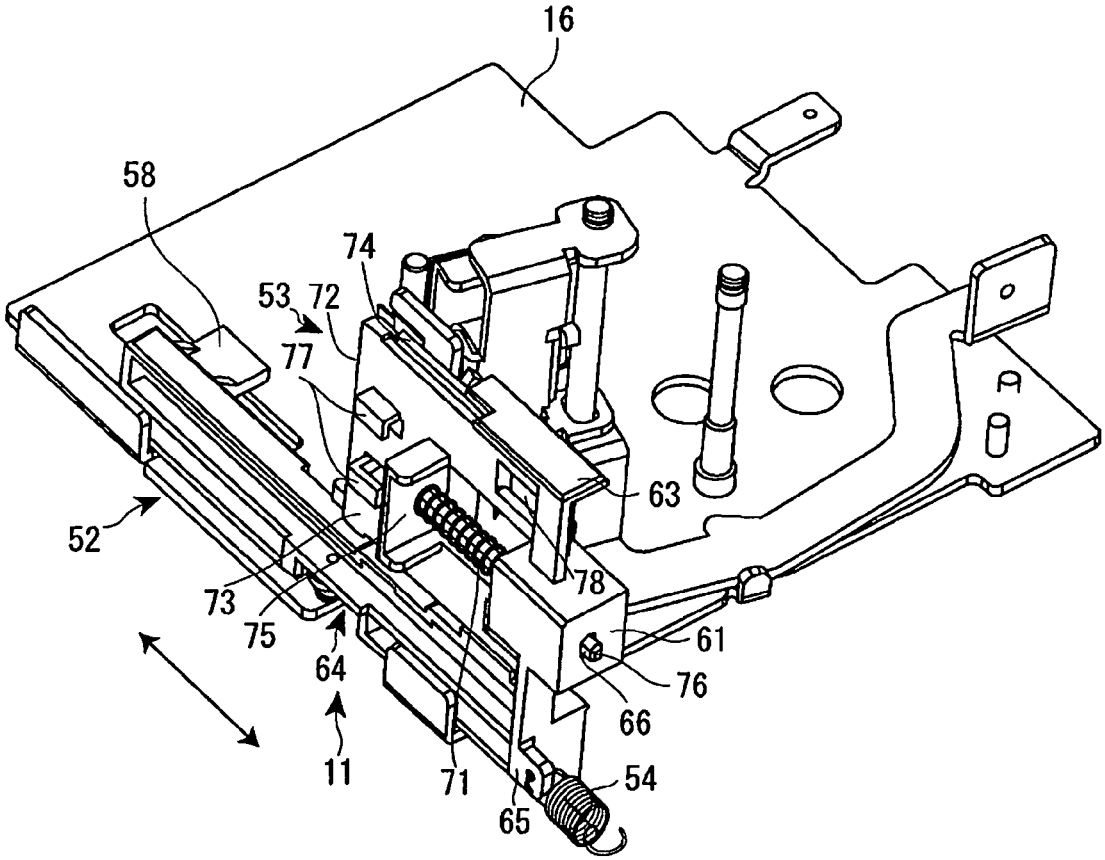
FIG. 6 is a perspective view of the tape cutting mechanism and the vicinity thereof.
Figure 7:
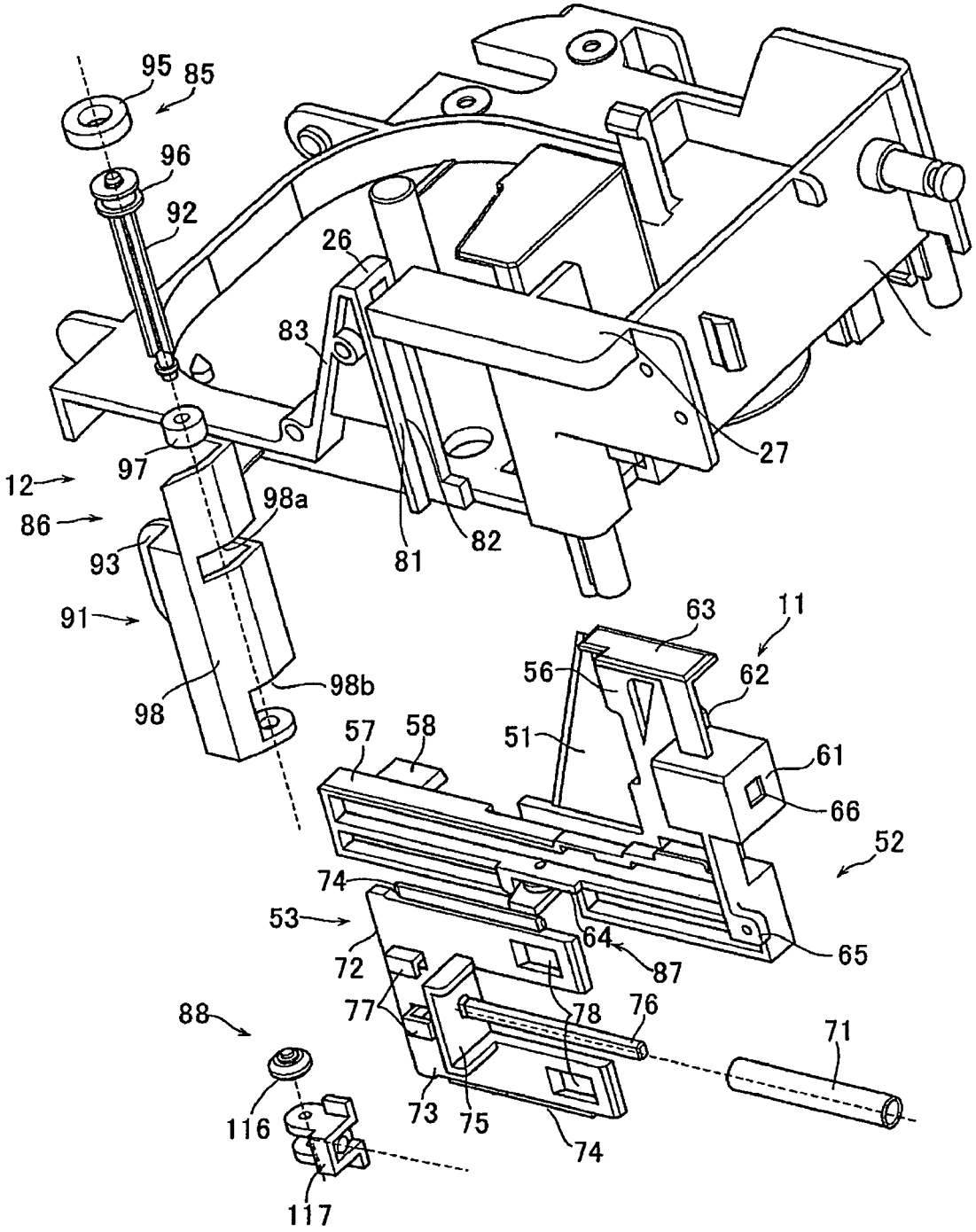
FIG. 7 is an exploded perspective view of the tape cutting mechanism, a power conversion mechanism and the vicinity thereof.

As shown in FIGS. 6 and 7, the tape cutting mechanism 11 has: an oblique cutter blade 51 cutting off the printing tape T; the "L"-shaped cutter holder 52 holding the cutter blade 51; the tape receiving section 26 receiving the cut printing tape T; a tape retaining member 53 retaining the printing tape T with the tape receiving section 26 preceding a cut of the cutter blade 51 into the printing tape T; and a return spring 54 returning the cutter holder 52 to a cutting wait position. The cutter holder 52 is slidably supported on the base plate 16 in a state that the tape retaining member 53 is retained. With the cooperation of the cut operation cam 46 and the return spring 54, the cutter holder 52 slides (cuts) reciprocatingly in directions shown by arrows (see FIG. 6).

The cutter holder 52 is formed integrally with: a holder body 56 holding the cutter blade 51 in which the cutter blade 51 cuts when pulled off; a holder base 57 being in communication with the bottom edge of the holder body 56 and extending in a sliding direction of the cutter holder 52; and an engaging projection 58 projecting horizontally from one end portion of the holder base 57 (see FIG. 7). The engaging projection 58 functions as a cam follower by engaging with the cut operation cam 46 described above. The cutter holder 52 is slidably supported on a bottom surface of the guide section 27 of the mounting plate 15 at the upper end of the holder body 56, and on the upper edge section of the base frame 16 at the lower end of the holder base 57. In this case, at the front end side of the holder body 56, the cutter blade 51 is mounted at the inner side (the cartridge mounting section 8 side) thereof, and the tape retaining member 53 is mounted at the outer side (the tape ejecting slot 9 side) thereof.

At the rear end side of the holder body 56 (at the right side in the figures), a box-like guide section 61 guiding the tape retaining member 53 horizontally is formed integrally with a pair of slide regulating bosses 62, 62 which are provided on the upper and the lower sides of the box-like guide section 61 and regulates a slide stroke of the tape retaining member 53. Also, a plate-shaped slide section 63 is integrally formed with a lower side groove. The slide section 63 is formed at the upper end of the holder body 56, is slidingly engaged with a guide section 27 of the mounting plate 15, and has the upper slide groove on the bottom surface thereof. The lower slide groove is formed at the lower end of the holder body 56 and is positioned at a boundary portion with the holder base 57. The tape retaining member 53 is slidably supported by the upper and the lower slide grooves. At the rear center in the box-like guide section 61, a square-shaped pin engaging hole 66 is formed, in which a spring holding rod 76 (described later) of the tape retaining member 53 penetrates.

At the lower central portion of the holder base 57, there is formed a recessed section 64 which is recessed toward the upper in a form of rectangular parallelepiped, in which a frictional top 101 and a check mechanism 102 (described later) are provided. At the rear end portion of the holder base 57, a spring engaging section 65 is formed, with which the return spring 54 is engaged.

The tape retaining member 53 is slidably attached to the cutter holder 52 in a state that the retaining member 53 is urged by a coil spring 71. The tape retaining member 53 has: a two-folked-like member body 73 forming a tape retaining surface 72 which faces to the tape receiving section 26; a pair of slide rail 74, 74 which are projectingly formed on the upper and the lower ends of the member body 73, respectively; a plate-like spring receiving piece 75 provided projectingly on the center of the member body 73; and a square bar-shaped spring holding rod 76 extending from the spring receiving piece 75 toward the rear. A fixing section 77 for attaching a tape piece receiving member 88 (described later) is formed in front of the spring receiving piece 75 on the member body 73.

The pair of slide rail 74, 74 are engaged in the upper and the lower slide grooves of the cutter holder 52 respectively, thereby the tape retaining member 53 is slidably supported on the cutter holder 52. Also, two-folked portions of the member body 73 have a pair of square-shaped holes 78, 78, respectively, each of which is engaged with the pair of slide regulating bosses 62, 62, respectively. Therefore, a sliding movement of the tape retaining member 53 is regulated as a slide stroke within a range in which each of the slide regulating bosses 62, 62 impinges on the front and the rear ends of each of the square-like holes 78, 78 in a sliding direction.

The coil spring 71 is held to penetrate in the spring holding rod 76. In this state, one end of the spring holding rod 76 penetrates in the box-like guide section 61 (the pin engaging hole 66) of the cutter holder 52. This causes the coil spring 71 to urge the spring receiving piece 75, that is, the tape retaining member 53 toward the tape receiving section 26 as a receiver with the bottom plate of the box-like guide section 61. The tape retaining surface 72 projects more slightly to the tape ejecting path 10 side than the cutter blade 51. When the cutter holder 52 slides in the forward sliding, the tape retaining surface 72 is in contact with the printing tape T preceding the cutter blade 51, and when the cutter holder 52 slides in the backward sliding, the tape retaining surface 72 separates away from the printing tape T following the cutter blade 51.

The tape receiving section 26 formed on the mounting plate 15 has a tape receiving surface 81 facing to the tape ejecting path 10. A slit opening 82 is formed extending to the upper and the lower directions on the tape receiving surface 81. The tape retaining member 53 abuts on a surface of the tape ejecting slot 9 side of the tape receiving surface 81 so as to interpose the printing tape T therebetween. The cutting cutter blade 51 (a forward sliding movement) is to enter into the slit opening 82. When the cutter holder 52 is in the forward sliding movement (a cutting movement), the tape retaining member 53 retains the printing tape T, and then, the cutter blade 51 cuts off the printing tape T.

Figure 8:
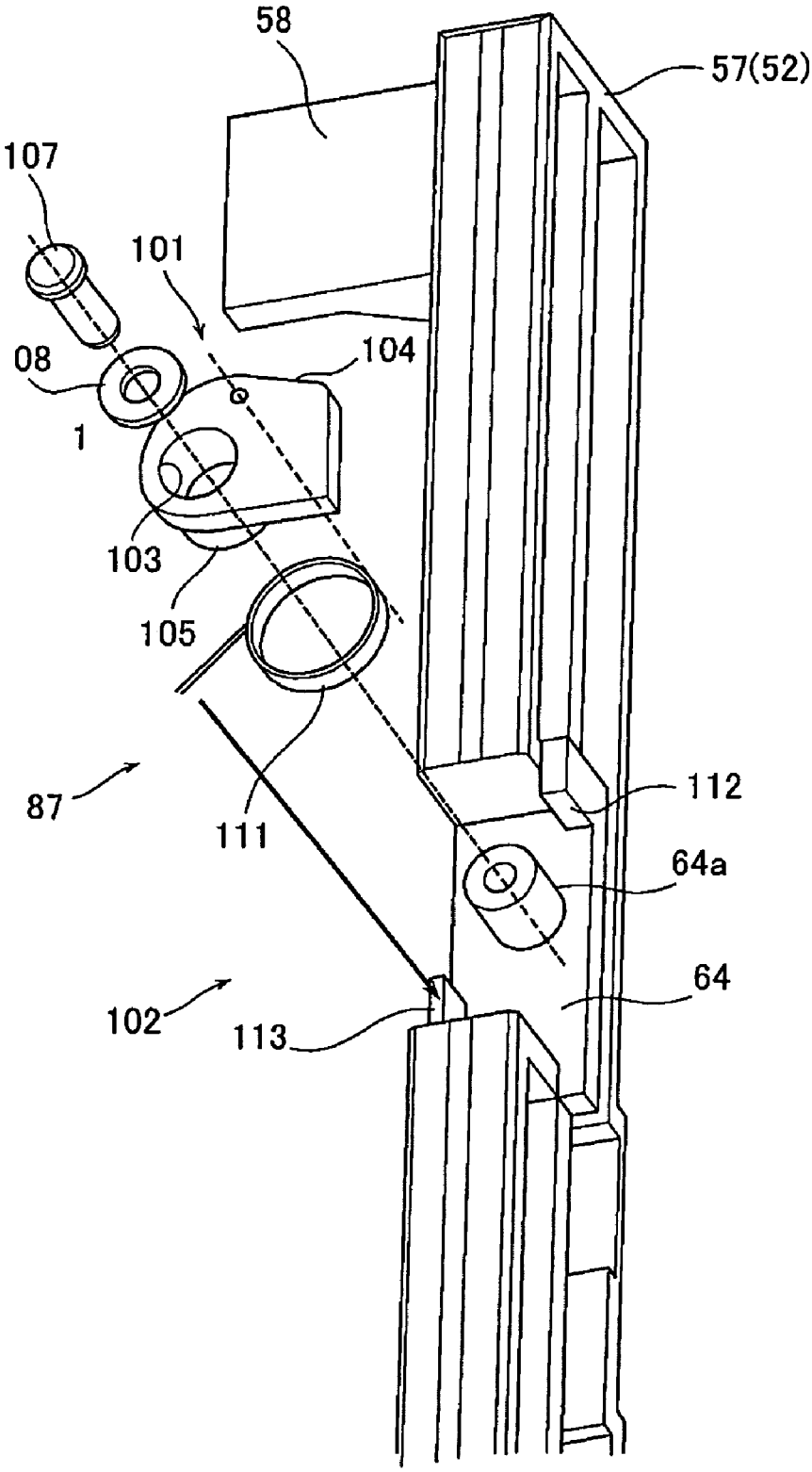
FIG. 8 is an exploded perspective view of the power conversion mechanism seen from below.

As shown in FIGS. 7 and 8, the tape ejecting mechanism 12 is to eject the tape piece Ta forcibly through the tape ejecting slot 9 by contacting in rotation with the tape piece Ta of the cut printing tape T. The tape ejecting mechanism 12 has: an ejecting roller unit 86 including an ejecting roller 85 which contacts in rotation with the tape piece Ta; a power conversion mechanism 87 which converts the backward sliding movement of the cutter holder 52 to a rotational movement of the ejecting roller 85 and transmits the rotational movement to the ejecting roller 85; and the tape piece receiving member 88 interposing the tape piece Ta with the ejecting roller 85, preceding a rotation of the ejecting roller 85.

The ejecting roller unit 86 has: a case-shaped unit holder 91; a roller shaft 92 accommodated in the unit holder 91 and of which the upper and the lower ends are rotatably supported on the unit holder 91; the ejecting roller 85 axially supported on the upper end of the roller shaft 92; and an ejecting drive roller (frictional wheel) 97 axially supported on the lower end of the roller shaft 92. Note that the ejecting drive roller 97 also serves as a component of the power conversion mechanism 87.

The unit holder 91 is formed integrally with a unit holder body 98 having an upper cutout 98*a* facing to the ejecting roller 85 and a lower cutout 98*b* facing to the ejecting drive roller 97 therein and an attaching piece section 93 extending from the unit holder body 56 along the mounting plate 15. By screwing the attaching piece section 93 on an oblique section 83 of the tape receiving section 26, the unit holder 91 is attached on the mounting plate 15. On the other hand, the ejecting roller 85 is formed with a rubber roller body 95 and a roller core section 96 formed integrally on the upper end of the roller shaft 92 and mounted with the roller body 95. Also, the ejecting drive roller 97 is, so called, a frictional wheel made of flexible rubber or the like, and is fixedly mounted at the lower end of the roller shaft 92.

The power conversion mechanism 87 has: an ejecting drive roller 97 fixed on the roller shaft 92; the frictional top 101 rotatably positioned between a sliding contact position in which the frictional top 101 is in sliding contact with the ejecting drive roller 97 and makes the roller 97 rotate and a pull-off position in which the frictional top 101 is pulled off from the ejecting drive roller 97; and the check mechanism 102 which allows a rotation of the frictional top 101 toward the pull-off position by the ejecting drive roller 97 when the cutter holder 52 moves in the forward sliding, and which retains the frictional top 101 at the sliding contact position when the cutter holder 52 moves in the backward sliding. In this case, the frictional top 101 and the check mechanism 102 are assembled in the holder base 57 of the cutter holder 52.

The frictional top 101 is formed integrally with a plate cam-like top body 104 having a shaft hole 103 at an eccentric position and a cylindrical boss section 105 extending from the top body 104 to the upper side. The frictional top 101 is rotatably attached at the recessed section 64 of the holder base 57 by a screw 107 and a washer 108. More specifically, a cylindrical body 64*a* projects downwardly from the recessed section 64 of the holder base 57, the frictional top 101 is mounted on the cylindrical body 64*a*, the screw 107 is screwed in a hole of the cylindrical body 64*a* with the washer 108, and then, the frictional top 101 is rotatably attached on the cylindrical body 64*a*. A front-end surface farthest from the shaft hole 103 is a sliding (a rolling) contact surface in sliding (rolling) contact with the ejecting drive roller 97.

The check mechanism 102 has a return spring 111 constituted by a torsion coil spring which urges the frictional top 101 toward the sliding contact position, and a contact section 112 formed in the recessed section 64 of the holder base 57 and holds the frictional top 101 in the sliding contact position against the return spring 111. The return spring 111 is held so as to be rolled on the boss section 105 of the frictional top 101, of which one end is engaged to the frictional top 101 and the other end is engaged to a plate-shaped projection 113 formed in the recessed section 64. Further, the contact section 112 projects at the front corner of the cartridge mounting section 8 side in the recessed section 64, that is, a portion in a diagonal position against the plate-shaped projection 113.

When the cutter holder 52 moves in the forward sliding (the cutting movement), the ejecting drive roller 97 contacts with the frictional top 101, and the frictional top 101 rotates against the return spring 111 (the pull-off position). When the ejecting drive roller 97 goes beyond the frictional top 101, the frictional top 101 is rotated by the return spring 111 and returns to the contacting position (the sliding contact position), in which the frictional top 101 comes into contact with the contact section 112. Thereafter, when the cutter holder 52 moves in the backward sliding (the returning movement), the ejecting drive roller 97 contacts with the frictional top 101 abutting with the contact section 112 and contacts slidingly (rollingly) with the front-end surface of the frictional top 101 to rotate.

The tape piece receiving member 88 has a sub roller 116 as a free rotational roller and a roller supporting section 117 rotatably supporting the sub roller 116 freely. The roller supporting section 117 is fixedly mounted on the fixing section 77 of the tape retaining member 53. The sub roller 116 is disjunctive with the ejecting roller 85, leaving the printing tape T therebetween. When the ejecting roller 85 rotates to eject the printing tape T, consequently the sub roller 116 is driven in rotation. Also, the sub roller 116 projects more to the tape ejecting path 10 side than the tape retaining surface 72 of the tape retaining member 53. When the cutter holder 52 moves in the forward sliding, the sub roller 116 contacts with the printing tape T preceding the tape retaining surface 72. When the cutter holder 52 moves in the backward sliding, the sub roller 116 separates away from the printing tape T, following the tape retaining surface 72. In other words, with the forward sliding movement of the cutter holder 52, the sub roller 116, the tape retaining surface 72 and the cutter blade 51 contact with the printing tape T sequentially, whereas, with the backward sliding movement thereof, the cutter blade 51, the tape retaining surface 72 and the sub roller 116 separates away from the printing tape T sequentially.

Next, referring to FIGS. 9A to 9C, 10D to 10F and 11G to 11I, the cutting movement and the ejecting movement for the printing tape T by the tape printing apparatus 1 will be explained.

Figure 9A:
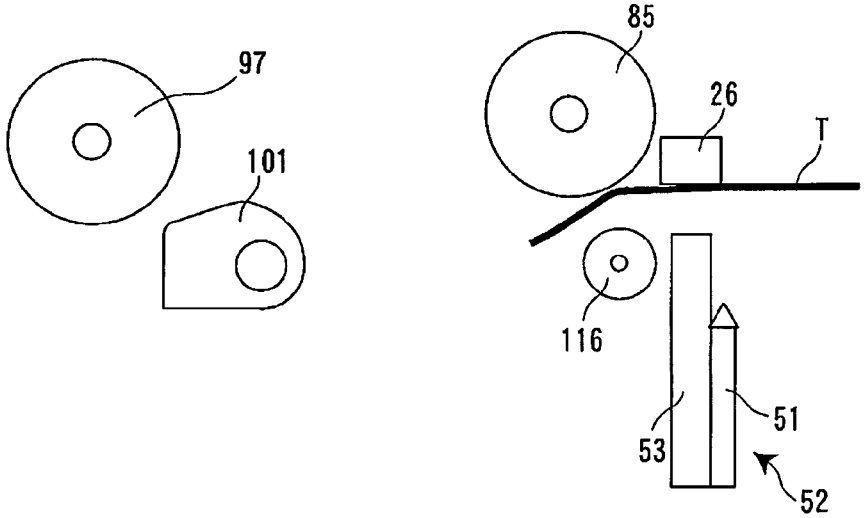
FIGS. 9A to 9C are first views for explaining a tape cutting movement and an ejecting movement.

At the cutting wait state after printing, the tape receiving section 26 faces to the tape retaining member 53 and the cutter blade 51 and the ejecting roller 85 faces to the sub roller 116 respectively, positioning the printing tape T therebetween (see the right figure of FIG. 9A). In this state, the frictional top 101 is not in contact with the ejecting drive roller 97 (see the left figure of FIG. 9A).

Figure 9B:
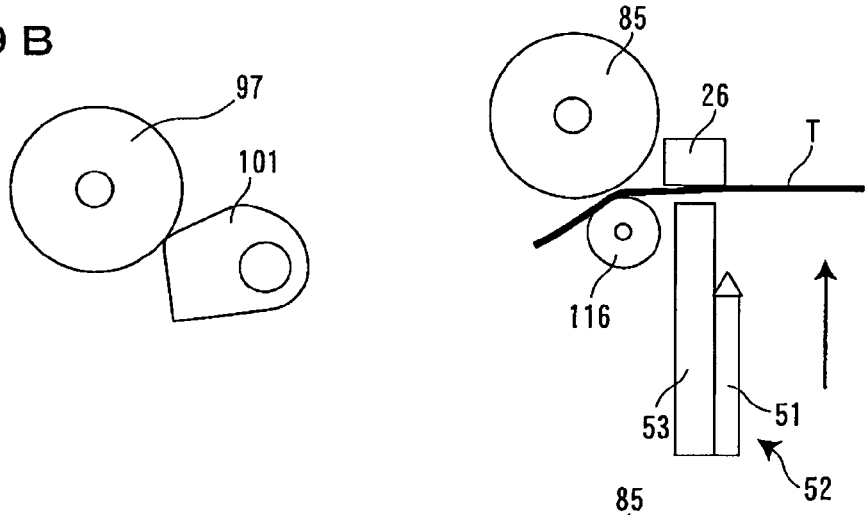
Figure 9C:
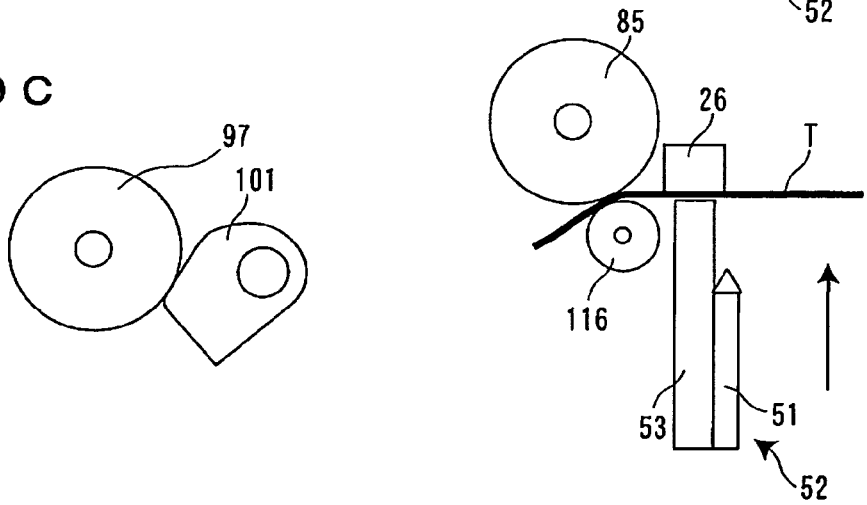

When the cutter holder 52 is pulled (moves forward) by the cut operation cam 46, the sub roller 116 contacts with the printing tape T preceding the tape retaining member 53, and the printing tape T is held by the sub roller 116 and the ejecting roller 85 (see the right figure of FIG. 9B). Following this procedure, the printing tape T is pushed on the tape receiving section 26 (the tape receiving surface 81) by the tape retaining member 53 (the tape retaining surface 72) (see the right figure of FIG. 9C). As the cutter holder 52 further advances, the cutter blade 51 cuts into the printing tape T while the tape retaining member 53 is retaining the printing tape T, then, the printing tape T is completely cut off (see right figures of FIGS. 10D and 10E). With these procedures, the frictional top 101 contacts with the ejecting drive roller 97, moves to the pull-off position, and then, returns to the sliding contact position (see the left figures of FIGS. 9B to 10E).

Figure 10D:
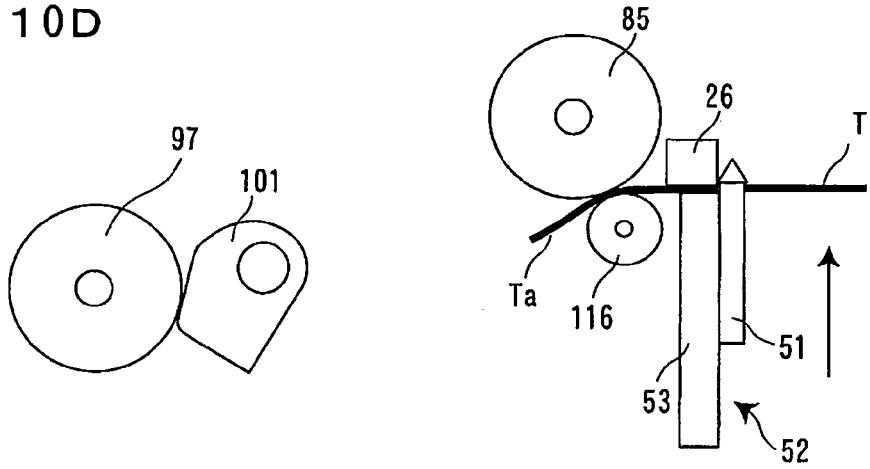
FIGS. 10D to 10F are second views for explaining the tape cutting movement and the ejecting movement.
Figure 10E:
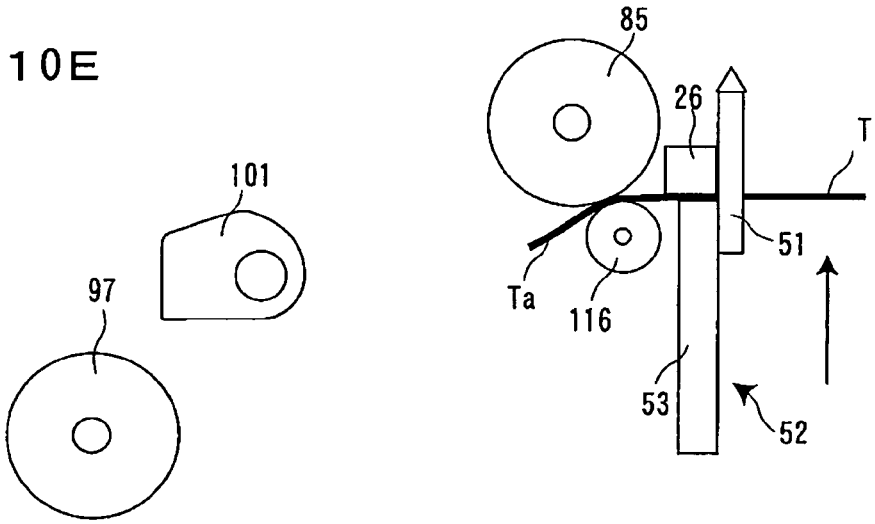
Figure 10F:
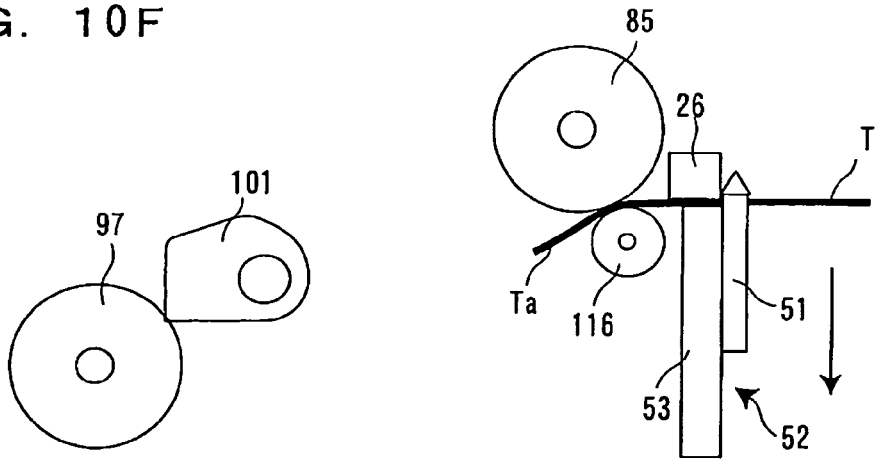
Figure 11G:
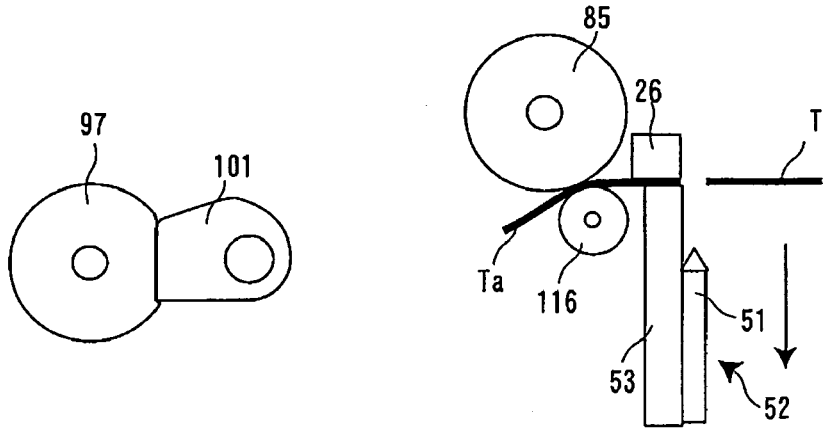
FIGS. 11G to 11I are third views for explaining the tape cutting movement and the ejecting movement.
Figure 11H:
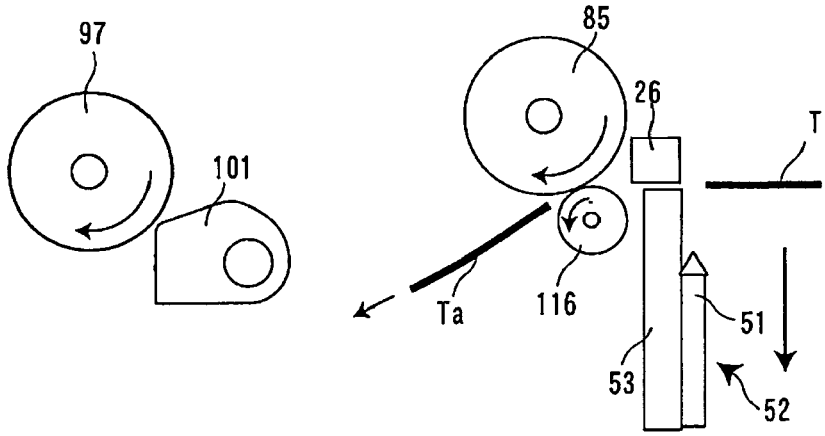
Figure 11I:
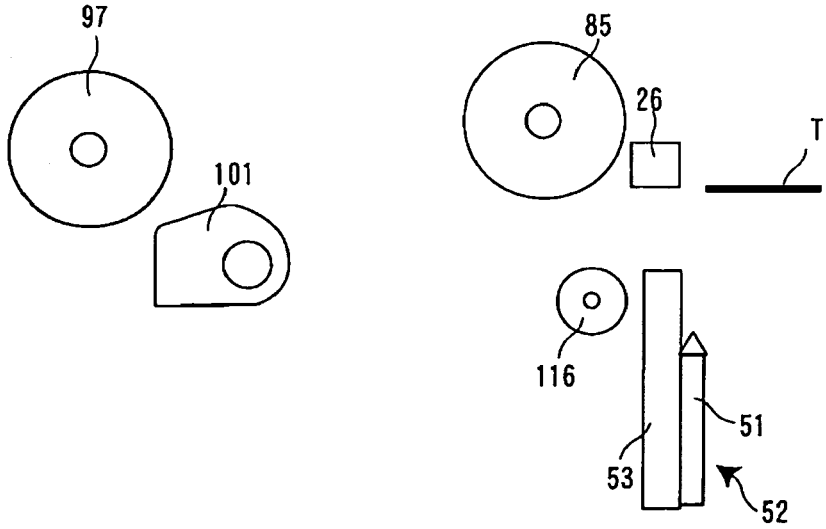

After the printing tape T is completely cut off and the cutter holder 52 retracts, the cutter blade 51 retracts while the tape retaining member 53 is holding the rear end portion of the tape piece Ta (see the right figure of FIG. 10F). At this time, that is, just before the tape retaining member 53 separates from the tape receiving section 26, the frictional top 101 begins to contact with the ejecting drive roller 97 (see the left figure of FIG. 10F). As the cutter holder 52 further retracts, the frictional top 101 is in sliding contact with the ejecting drive roller 97 steadily and makes the roller 97 rotate (see the left figures of FIGS. 11G and 11H). At the same time, the tape retaining member 53 separates from the tape piece Ta. The ejecting roller 85 rotates in a direction described by an arrow in conjunction with a rotation of the ejecting drive roller 97, thereby the sub roller 116 rotates in a direction described by an arrow (see the right figures of FIGS. 11G and 11H). Thus, the tape piece Ta is forcibly ejected through the tape ejecting slot 9 outside the apparatus. Thereafter, the cutter holder 52 returns to the cutting wait position (see FIG. 11I) and the cutting movement and the ejecting movement are completed.

As described above, according to the embodiment, the backward sliding movement of the cutter holder 52 is converted to the rotational movement for the ejecting roller 85 and the rotational movement is transmitted to the ejecting roller 85. Therefore, just after the printing tape T is cut off, a power for forcible ejection is imparted to the tape piece Ta with the ejecting roller 85. Therefore, it is certainly possible to eject the tape piece Ta through the tape ejecting slot 9 outside the apparatus.

What is claimed is:

1. A tape processing apparatus comprising:

a tape cutting device which slides a cutter holder having a cutter blade attached therein in a reciprocating sliding directions and cuts a tape by a forward sliding movement thereof; and a tape ejecting device which faces to a tape ejecting path from the tape cutting device to a tape ejecting slot and eject a tape piece of the tape forcibly from the tape ejecting slot by contacting in rotation with the cut tape piece; wherein the tape ejecting device has: an ejecting roller which contacts in rotation with the tape piece; and a power conversion mechanism which is placed between the ejecting roller and the cutter holder, converts a backward sliding movement of the cutter holder to a rotational movement for the ejecting roller, and transmits the rotational movement to the ejecting roller; and the power conversion mechanism comprises: a frictional wheel fixed on a roller shaft of the ejecting roller; a frictional top which is provided in the cutter holder and is capable of rotating freely between a sliding contact position in which the frictional top is in sliding contact with the frictional wheel and makes the frictional wheel rotate and a pull-off position in which the frictional top is pulled off from the frictional wheel; and a check mechanism which is provided in the cutter holder, allows the frictional top to rotate toward the pull-off position by the frictional wheel in the forward sliding movement of the cutter holder and holds the frictional top at the sliding contact position in the backward sliding movement.

2. The tape processing apparatus according to claim 1, wherein the tape ejecting device further comprises a receiving member for the tape piece which is provided in the cutter holder and interposes the tape piece with the ejecting roller preceding a rotation of the ejecting roller.

3. The tape processing apparatus according to claim 2, wherein the receiving member for the tape piece comprises a sub roller provided rotatably in the cutter holder.

4. The tape processing apparatus according to claim 1, wherein the check mechanism comprises a return spring which urges the frictional top toward the sliding contact position, and a contact section which holds the frictional top at the sliding contact position against the return spring.

5. The tape processing apparatus according to claim 1, wherein the tape cutting device further comprises a tape receiving member which faces to the tape ejecting path and receives the tape in cutting and a tape retaining member which is provided in the cutter holder and retains the tape with the tape receiving member preceding a cut of the cutter blade into the printing tape, the frictional top begins to contact slidingly with the frictional wheel just before the tape retaining member separates from the tape receiving member in the backward sliding movement of the cutter holder.

6. The tape processing apparatus according to claim 5, wherein the sub roller, the tape retaining member and the cutter blade contact with the tape sequentially in the forward sliding movement of the cutter holder, and the cutter blade, the tape retaining member and the sub roller separates from the tape T sequentially in the backward sliding movement of the cutter holder.

7. The tape processing apparatus according to claim 1, further comprising a printing device which prints on the tape.

* * * * *